US005516353A

United States Patent [19]

Sahai et al.

[11] Patent Number: 5,516,353

[45] Date of Patent: May 14, 1996

[54] SEPARATION OF METAL DROPLETS OF ALUMINUM AND ITS ALLOYS FROM MOLTEN SALTS BY APPLICATION OF ELECTRICAL POTENTIAL

[75] Inventors: Yogeshwar Sahai; Jian Ye, both of Columbus, Ohio

[73] Assignee: The Ohio State University, Columbus, Ohio

[21] Appl. No.: 190,458

[22] Filed: Feb. 2, 1994

[51] Int. Cl.[6] ..... C21B 11/10

[52] U.S. Cl. ..... 75/10.1

[58] Field of Search ..... 75/10.1; 204/67

[56] References Cited

U.S. PATENT DOCUMENTS 400,664 4/1889 Hall ..... 204/67
400,666 4/1889 Hall ..... 204/67

OTHER PUBLICATIONS

Choo et al., "Experimental Studies of the Electrodynamic Behaviour of Metal amd Metal Sulphide Droplets in Slags", *Proceedings of Copper 91,* vol. IV, 1991, pp. 409–424.

Choo et al., "The Electrodynamic Bahavior of Metal and Metal Sulphide Droplets in Slags", *Canadian Metallurgical Quarterly,* vol. 31, No. 2, 1992, pp. 113–126.

*Primary Examiner*—Peter D. Rosenberg
*Attorney, Agent, or Firm*—Frank H. Foster; Kremblas, Foster & Millard

[57] ABSTRACT

The invention relates to the application of an electric potential to a mixture of molten metal droplets, molten salts, and optionally certain fluoride salt additives, whereby the molten metal migrates toward one of the electrodes. The migration encourages increased coalescence of the droplets into larger particles, whereby increased recovery of the metal from the mixture is achieved.

21 Claims, 9 Drawing Sheets

Table 1 Metal-molten salt systems investigated

| Molten salts | Metals | |
|---|---|---|
| (NaCl-KCl) + additive | Pure Al | UBC |
| no additive | N | N |
| 5wt% LiCl | N | N |
| 5wt% $CaCl_2$ | N | N |
| 5wt% $CaF_2$ | N | N |
| 5wt% $MgF_2$ | N | N |
| 5wt% NaF | Y | Y |
| 5wt%KF | Y | Y |
| 5wt%LiF | Y | Y |
| 5wt%$Na_3AlF_6$ | Y | Y |

"N" stands for no metal droplet movement observed
"Y" stands for metal droplet movement observed

FIG. 9

SEPARATION OF METAL DROPLETS OF ALUMINUM AND ITS ALLOYS FROM MOLTEN SALTS BY APPLICATION OF ELECTRICAL POTENTIAL

TECHNICAL FIELD

The invention relates to a novel method to reduce the amount of metal loss occurring in the remelting process of secondary aluminum alloys under molten salt cover by the electrocapillary phenomena. The invention is useful in the recycling of aluminum (and its alloys) scrap, including used beverage cans.

BACKGROUND ART

As recycling of aluminum increases, melting losses still are as much as 10% of the dross weight, representing an enormous loss of material and energy. Loss of valuable metals as a result of the formation of suspensions of both fine and relatively large droplets of molten metal in the molten (very thick or viscous) salt solution is the major concern in the secondary aluminum recycling industry. The most common method conventionally used to minimize the oxidation losses of metal such as aluminum is the use of a protective molten salt cover, called flux, in the charging well of the reverberatory furnace generally used for melting scrap metal. Such a molten salt also is added in a rotary furnace generally used for recycling skims and drosses, and these may contain as much as 85% metallic aluminum. The molten salt flux serves the multiple purposes of protecting aluminum from further oxidation and/or combustion, stripping the protective oxide film from the molten metal so the droplets can more easily coalesce, and holding the stripped solid oxide particles in suspension so that a clean metal can be recovered.

It is common in such secondary aluminum remelting to use a mixture of equimolar sodium and potassium chlorides as the salt flux because of the low cost and the low eutectic temperature in this system. A small amount of fluorides, such as KF, NaF, cryolite, etc., is frequently added to the binary mixture of the chlorides. Although aluminum oxide, if formed, may be dissolved by fluorides, such as cryolite, the presence of sodium chloride in molten salts lowers the solubility of the aluminum oxide to insignificant levels. Thus, the action of the salt flux in assisting coalescence of metal droplets results from the stripping of the oxide films rather than the actual dissolution of the oxide. It is believed that the stripping is due to the interfacial stress created by interfacial tension gradient. The interfacial tension depends not only on the interfacial potential between the molten metal and molten salt, but also on the surface charge in the metal droplet surface. This phenomenon is known as electrocapillarity, but has not been developed in metal-salt systems because of experimental difficulties.

The salt forms a cover which thickens over time. This salt cover, or dross, prevents oxidation of the molten metal beneath and accumulates the stripped oxides, such as magnesium oxide and aluminum oxide. When the dross becomes very thick, it is usually removed but it contains a significant amount of entrapped molten aluminum, thereby reducing the aluminum yield. Conventionally, large rollers are used to squeeze the removed dross to thereby recover about half of the trapped metal, however, the dross still contains 10% metal which is not recovered and is lost.

Stirring of the molten metal/molten salt mixture to improve the yield of metal is not practical on a commercial scale because of the size of the vessels. Therefore, it would be desirable to have a method for mixing the materials and thereby allow the small molten metal droplets to coalesce into larger particle sizes to increase the recoverable yield.

BRIEF DISCLOSURE OF INVENTION

The present invention involves the application of electrochemistry to process metallurgy using the electrocapillary phenomena to reduce the metal loss in the remelting process of secondary aluminum and aluminum alloys scrap, including those derived from Used Beverage Cans (hereinafter UBCs).

By applying an electric field or voltage potential to a solution or mixture of molten metal droplets, molten salts and optional salt additives, an interfacial tension gradient is created. The difference between interfacial tensions along the interface between a molten metal droplet and the molten salt surrounding it causes the metal droplet to move from a first area in the electric field or potential gradient to a second area in the electric field or potential gradient. The interface motion drags along the adjacent layers of the molten salt, and this results in a relative movement of the droplet as a whole.

The change in interfacial tension on the interfacial potential is given by the Lippmann equation:

$$q_M = -\frac{\partial \gamma}{\partial \Delta \psi} \tag{3}$$

Based on the Lippmann equation, the Millikan oil drop experiment, and the Navier-Stokes equations, one can calculate the velocity of a droplet of molten metal, such as aluminum, within a mixture of molten salts. By moving the molten metal droplets in the molten salt suspension toward a position close to the anode, which increases opportunity for contact among fine droplets. The contact produces increased coalescence, resulting in the formation of larger sized particles which will provide more opportunity to fall out of the suspension. In this manner, the amount of recoverable metal is increased relative to the metal recovery from a salt-metal suspension without an applied potential.

BRIEF DESCRIPTION OF DRAWINGS

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

FIG. 9 lists several molten salt systems and indicates metal droplet movement for pure Al and UBC alloy.

DETAILED DESCRIPTION

Figure 1:
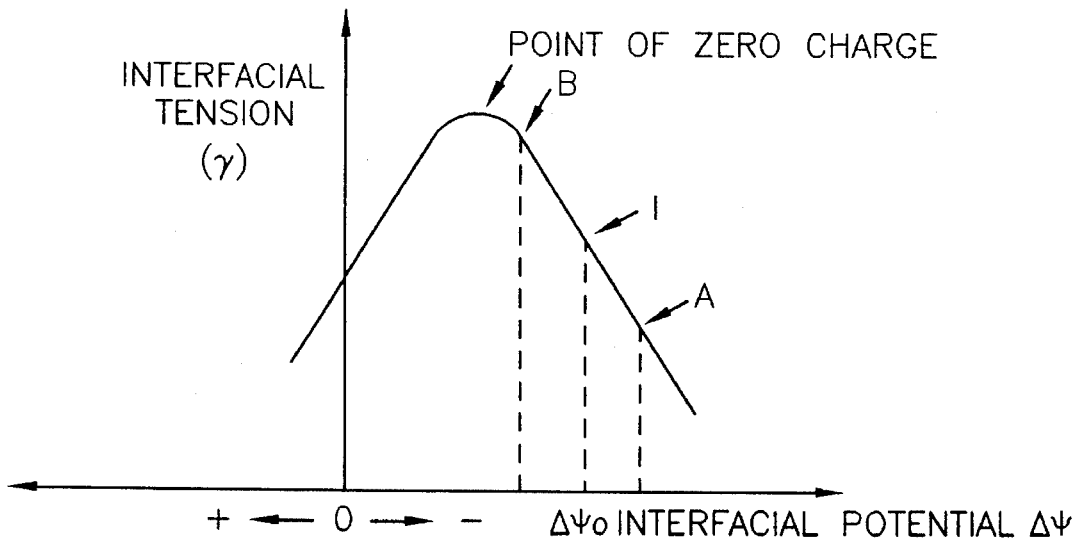
FIG. 1 illustrates a schematic electrocapillary curve graphing interfacial tension versus interfacial potential.

The invention is directed to a method for increasing the yield of recovered metal, such as aluminum, from a solution of molten metal droplets and molten salt, said method comprising the steps: (a) immersing a first and second electrodes into a solution comprising molten salt and molten metal droplets; (b) applying an electrical potential between the electrodes, whereby the first electrode becomes the anode and the second electrode becomes the cathode, whereby the electrical potential is applied for a time and at a level sufficient to induce the molten metal droplets to migrate toward the anode; and (c) finally, collecting the molten metal at the anode, whereby the yield of metal recovered is greater than the yield obtained (1) without the addition of molten salt to the solution, and (2) without an applied potential.

By "solution" herein is meant a mixture or co-melt of materials including a molten salt or salts and at least one fluoride salt additive. "Solution" herein is not meant to necessarily imply complete dissolution and ionization of the components, but rather mixtures, blends, and dispersions are included in "solution". In one embodiment, "solution" can be waste dross removed from a molten aluminum and molten salt recycling system, whereby aluminum is recovered from the collected waste dross.

By "droplet" herein is meant the liquid or liquid-like state of a molten or softened metal, without limitation with regard to its size, upon its exposure to elevated temperatures. Thus, by "droplet" herein is also included melted and partially melted particles, particles that have coalesced into chunks or pieces, or other forms of the metal able to migrate under the influence of the applied potential.

By "metal" herein is meant aluminum, alloys of aluminum, UBCs, and the like, and mixtures thereof. Common alloys of aluminum used in the container industry include AA5182 and AA3004. These alloys vary in elemental analysis, with AA5182 commonly having 4.0–5.0 wt. % magnesium, 0.2–0.50 wt. % manganese, 0.20 wt. % silicon, 0.35 wt. % iron, while AA3004 has relatively lower magnesium content of 0.8–1.3 wt. %, higher wt. % manganese of 1.0 to 1.5, about 0.30 wt. % silicon, and 0.70 wt. % iron. Thus, the present invention could be used on mixtures of, for example, AA3004 and AA5182, or either or both of these plus relatively pure aluminum. UBC's usually contain AA5182 alloy in the end piece, and AA3004 in the can body, with a total ratio of 25 weight percent AA5182 and 75 weight percent AA3004.

According to the present invention, when the droplets migrate toward the anode under the influence of the applied potential, they may coalesce and form bigger drops or chunks of metal, which will become easier to separate from the salt flux or dross. Fine droplets of molten metal are often of insufficient mass to settle out of the suspension from gravity alone. By the present invention, coalescence is encouraged and droplet or particle size is increased whereby the applied potential can assist gravity in increasing the yield of recovered metal.

The electrocapillary curve for an aluminum droplet in a molten salt based on equimolar NaCl—KCl is not available. However, a representative schematic electrocapillary curve is shown in FIG. 1, exhibiting interfacial tension $\gamma$ (gamma) on the vertical, or "y" axis, and applied potential $\Delta\psi$ (delta psi) on the horizontal, or "x" axis. The metal droplet inside the molten salt mixture should have an interfacial tension value at point I, and an interfacial potential at $\Delta\psi_o$ (delta psi naught).

Figure 2:
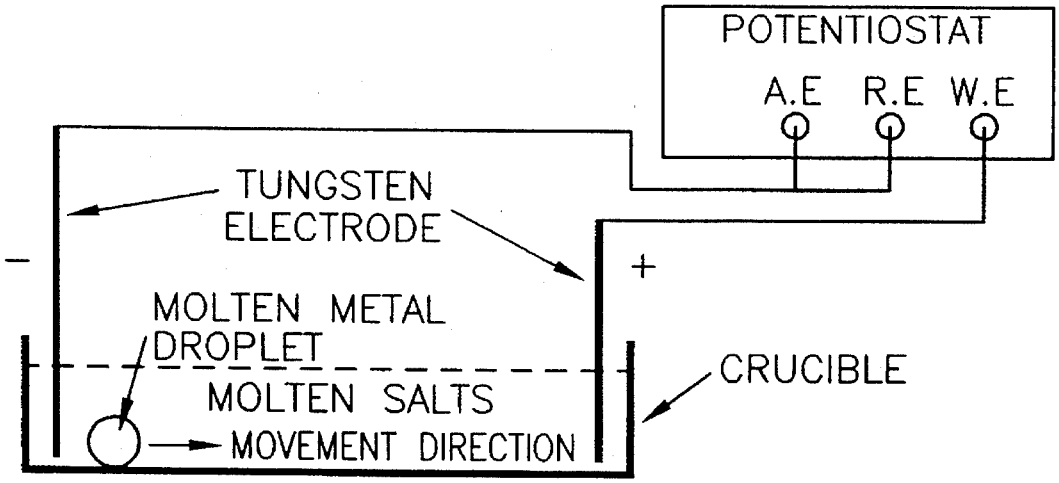
FIG. 2 represents an illustration of a molten metal droplet within a molten salt system as the metal droplet migrates toward the anode under the influence of an electric potential.

FIG. 2 represents an illustration of a molten metal droplet within a molten salt system as the metal droplet migrates toward the anode under the influence of an electric potential. FIG. 2 illustrates the areas of relatively high and low interfacial tension $\psi$ (gamma) and the direction of interfacial movement on the surface and interior of the droplet. As a d.c. potential is applied to the area surrounding the droplet, the interfacial potential at point (A) in both FIG. 1 and FIG. 2 becomes equal to $\Delta\psi_o$ (delta psi naught)—f(V), while the interfacial potential at point (B) in both Figs. is $\Delta\psi_o$ (delta psi naught)+f(V), where f(V) is the change in interfacial potential due to the externally applied potential. According to FIG. 1, the interfacial tension at point (A) is then less than the interfacial tension at point (B), i.e., an interfacial tension gradient has been created by applying the d.c. potential. The combination of lower interfacial tension at point (A) and higher interfacial tension at point (B) causes the metal droplet to move from the point (A) to point (B) along the interface and in the opposite direction within the droplet itself.

Figure 3:
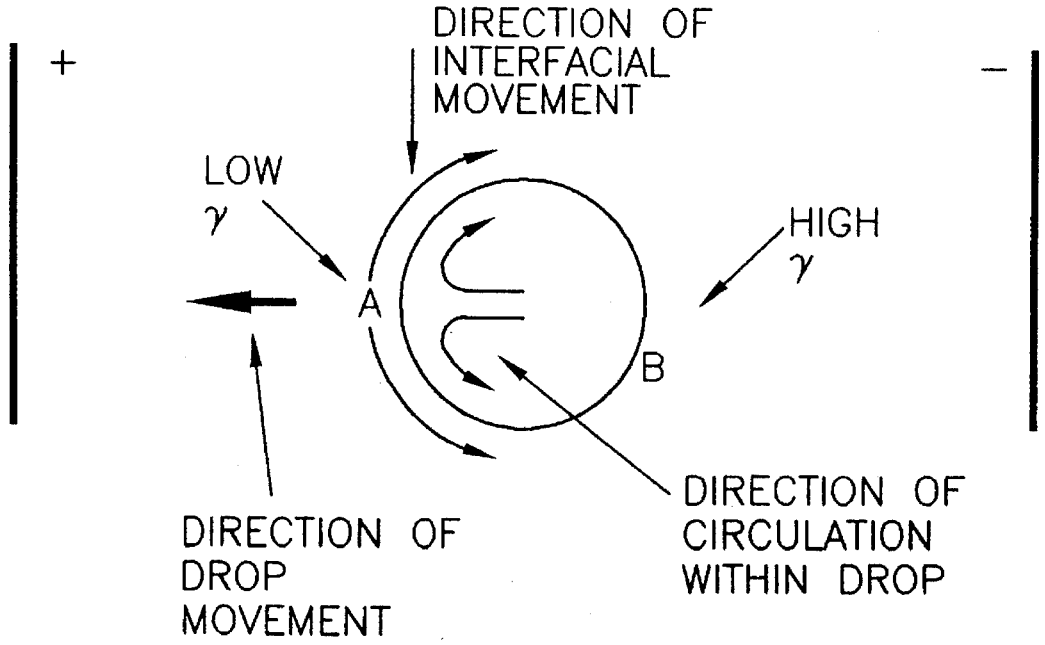
FIG. 3 illustrates a schematic diagram of one embodiment of the present invention.

FIG. 3 illustrates one embodiment of the present invention. Two electrodes are inserted into the two ends of a receptacle or boat which contain the molten salts. The electrodes can be of any current-conducting material, such as but not limited to, graphite, carbon, and molybdenum, and mixtures thereof, however, tungsten is the preferred metal for the electrodes.

The boat or other container can be of any material such as common refractory materials with a melting point temperature high enough to not soften during the recycling of the metal. While $Al_2O_3$, SiC, MgO, $SiO_2$, such as quartz, and SiN materials are useful herein for the fabrication of the boat or receptacle, a preferred material herein for the receptacle or boat comprises boron nitride. Quartz is relatively inexpensive as the boat material, however, aluminum can react with the quartz to reduce the ability of the metal to slide along the quartz boat wall. The size of the boat is not limited herein, and all useful sizes and shapes of the receptacle or boat are included in the present invention.

According to the present invention, the migrating molten metal droplets move toward and near the anode under the influence of the applied potential. As the density or population of these molten metal droplets increases, the droplets are able to coalesce into easily recoverable metal. In this manner, the yield of recovered metal is increased relative to recovery systems without an applied electrical potential and salt additives in the molten salt system. It is not necessary according to the present invention to squeeze the waste dross for additional metal because essentially most of the metal has been pulled out of the solution and dross and toward the anode, and coalesced.

In addition to increasing the total recovery yield, the present invention also reduces the time required for recovering molten metal. The droplets can move rapidly through the molten salt system, depending on the purity of the system.

The invention also prolongs the useful life of the salt system since more metal is recovered from the salt than is recovered in the absence of an applied potential. Thus the same volume of salt can be used for longer periods of time, thereby providing a distinct economic advantage.

Another advantage of the present invention is in the reduction of wastes. Thick salt or dross cannot be thrown into waste streams or used as landfill. The dross is cleaned and its constituents are reused, or alternatively can be properly disposed of easier than dross removed from conventional systems. The waste dross resulting from the recovery of aluminum by the present invention has reduced aluminum content relative to the aluminum content of waste dross from conventional aluminum recovery methods. As a result, this invention reduces the amount of waste dross generated per unit volume of recycled aluminum metal.

Thus, the present invention provides an improved method for recovering molten metal from a solution of molten metal droplets and molten salt, said improvement comprising applying to a solution of molten metal droplets, molten sodium chloride, molten potassium chloride, and an additive selected from the group consisting of any fluoride salt, such as but not limited to sodium fluoride, potassium fluoride, cryolite, and lithium fluoride, an electrical potential by means of two electrodes immersed in the solution, whereby the molten metal droplets migrate toward the electrode which is acting as an anode, and whereby the molten metal droplets coalesce and are recovered at or near the anode in an increased yield, relative to the yield obtained without an applied field. The inventors believe but do not wish to be limited to the theory that the presence of fluoride in the solution improves the critical angle of the droplet on the vessel wall or bottom, which may increase the mobility of the droplet. In addition, the presence of the fluoride additive increases the rate of coalescence.

The method of the present invention can also be applied (1) to the removed dross to recover the trapped droplets of molten metal therein, (2) to the mixture of salts and metal in a static furnace, or (3) to the mixture of salts in a continuous or dynamic furnace.

According to the present invention, the preferred salts useful in the solutions of the present invention are sodium chloride and potassium chloride, with small additions of other fluoride salts. The proportions of the sodium and potassium chloride salts can range from about 30 to about 60 mole percent, but the preferred molten salt system herein is an equimolar mixture of sodium chloride and potassium chloride because this is the eutectic mixture and melts at the lowest temperature among possible mole ratios. Proportions of potassium chloride and sodium chloride other than equimolar are useful herein, since for example, sodium chloride is very inexpensive, however, the melting point is increased as the ratio varies in either direction from equimolar and the energy input required is therefore increased.

The preferred salt additives in the present invention are mono-fluoride salts, such as KF, LiF, and NaF preferably used at levels in the molten salt solution of from about 0.1 to about 15 weight percent. The concentration of additive can be as high as the saturation or solubility limit of the additive in the sodium chloride/potassium chloride mixture, however, this upper limit is not economical. The molten salt additives useful herein can include materials comprising, for example, lithium chloride, calcium chloride, calcium fluoride, lithium fluoride, potassium fluoride, magnesium fluoride, sodium fluoride, sodium aluminum fluoride ($Na_3AlF_6$), and mixtures thereof, and precursors comprising these materials or yielding in situ these materials are useful in the present invention. The salts used herein need not be reagent-grade salts, and in fact, in industrial applications the present invention can employ very crude and contaminated salt melts.

Thus, in one embodiment the present invention is directed to a method for increasing the yield of recovered metal from a solution of molten metal droplets and molten salt, said method comprising the steps: (a) immersing a first and second electrodes into a solution comprising molten salt and molten metal droplets; (b) applying an electrical potential between the electrodes, whereby the first electrode becomes the anode and the second electrode becomes the cathode, whereby the electrical potential is applied for a time and at a level sufficient to induce the molten metal droplets to migrate toward the anode; and (c) collecting the molten metal at the anode, whereby the yield recovered is increased relative to the yield of molten metal recovered in the absence of an applied electrical potential.

The present invention differs from electroplating because in the present invention the materials are not "in solution", that is, the materials are not ionized as in electroplating. Rather, in the present invention the droplets of molten metal are dispersed in the molten salt mixture and migrate as a result of the effect of the applied electro-potential.

In practicing the present invention, a piece of metal, such as an aluminum ingot, aluminum alloy or a UBC slug, is shredded and put into the container near the negative electrode and is exposed to the molten salts for a time sufficient to melt or at least partially melt the metal. The temperature of the molten salts can vary depending on the composition of the salt mix and the temperature is not a limitation herein. Alloy AA5182 has a melting range of 1077°–1078° F., while AA3004 has a melting range of 1165°–1210° F. Pure aluminum has a melting point of 660° C. (1220° F.).

Once the metal has at least partially melted, a d.c. potential is applied to the boat and its contents by, for example, a potentiostat, whereby the metal droplets are caused to move toward the positive electrode (anode). The size of the electrical potential useful in the present invention can be any potential sufficient to initiate migration of the charged metal droplet toward the anode, whereby increased coalescence and yield of molten metal at or near the anode is achieved. The applied voltage can therefore vary from, for example, a low voltage of less than about 1.0 volt up to the decomposition potential of each salt in the salt mixture. A preferred voltage range herein is from about 1.0 volt to about 5.0 volts. The time required for the molten metal to migrate through the molten salts and optional salt additives will depend upon the viscosities, the applied voltage potential, the type of molten metal, and the type of salt additive. The migration rate of the droplet is a direct function of the applied potential but is also related to the droplet radius.

Using the procedure described above, several metal-molten salt systems were evaluated for their ability to produce movement of molten metal toward the anode. It was noted that in all chloride molten salts, the molten metal, specifically pure aluminum or a UBC alloy comprising 1.91% Mg, 0.79% Mn, 0.03% Si, and 0.04% Fe, did not move significantly toward the positive electrode. Similarly, a molten salt comprising NaCl—KCl plus $MgF_2$, and a molten salt comprising NaCl—KCl plus $CaF_2$ did not produce significant movement of the molten aluminum or molten UBC alloy. This is illustrated in FIG. 9 lists several molten salt systems of the present invention and indicates metal droplet movement for pure Al and UBC alloy.

Systems comprising (NaCl—KCl)+XF, where X is selected from the group consisting of Na, K, Li and $Na_3Al$, were very effective according to the present invention in facilitating aluminum or UBC alloy molten droplet movement toward the anode. It is therefore clear that the metal droplet was negatively charged, and these molten salt systems are believed to have lower interfacial tensions than those chloride-containing systems described above.

Figure 4:
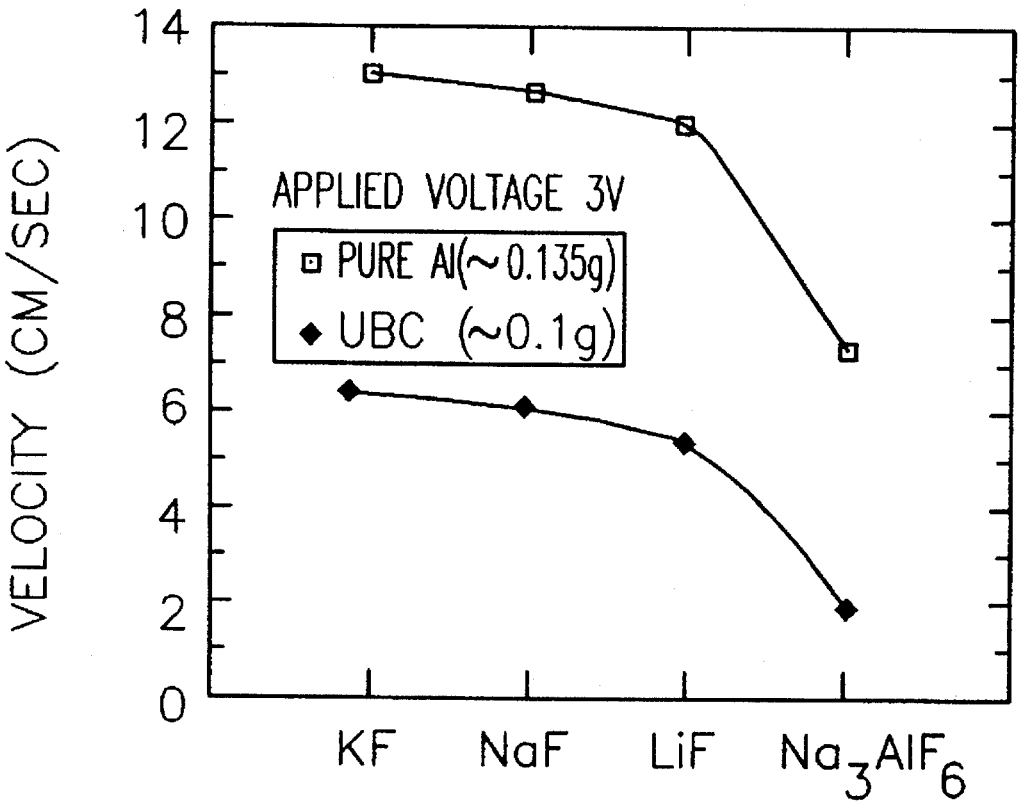
FIG. 4 illustrates a graph of velocity of metal droplets rs. various fluoride additives (at 5 wt. %) added to an equimolar NaCl—KCl molten salt system

FIG. 4 illustrates a graph of velocity of metal droplets vs. various fluoride additives (at 5 wt. %) added to an equimolar NaCl—KCl molten salt system. FIG. 4 compares the velocities (cm/sec) of droplets of pure aluminum and synthetically prepared UBC alloy (1.91% Mg, 0.79% Mn, 0.03% Si, and 0.04% Fe) in the different molten salts. FIG. 4 illustrates that the velocity for droplets of pure aluminum is higher in a given molten salt than the velocity for droplets of the UBC alloy in the same molten salt. Also, the velocities of the molten metal droplets in NaCl—KCl with the addition of NaF, KF, LiF were almost the same. However, in the NaCl—KCl+ $Na_3AlF_6$ molten salt system, smaller velocities were measured.

Figure 5:
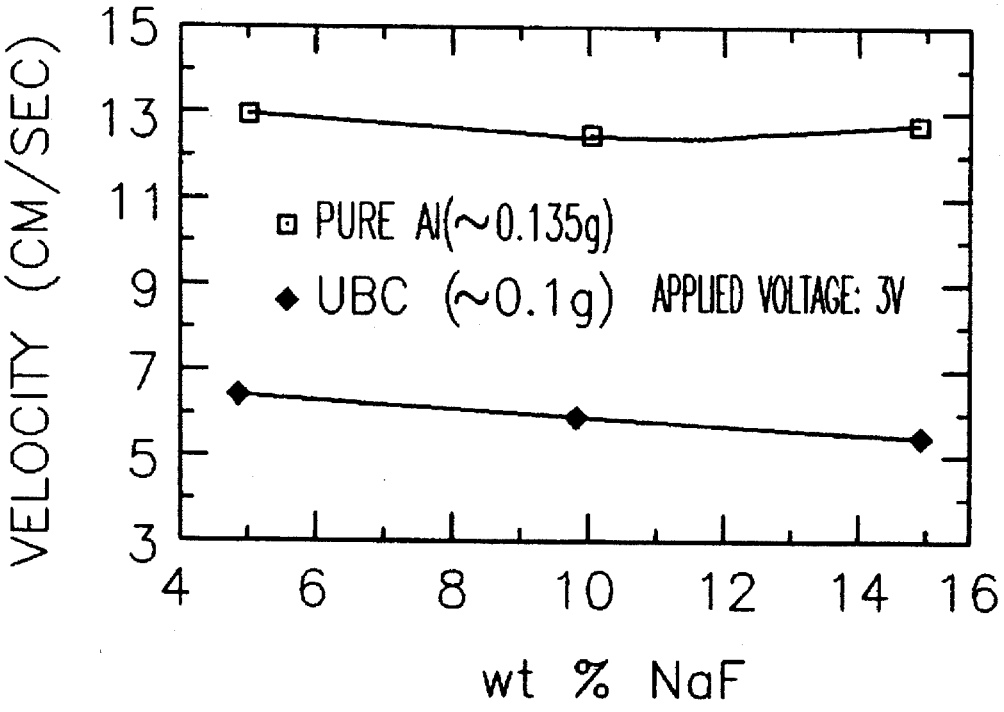
FIG. 5 illustrates a graph of velocity of metal droplets vs. varying wt. % concentration of sodium fluoride in an equimolar NaCl—KCl molten salt system.

FIG. 5 illustrates a graph of velocity of metal droplets vs. varying wt. % concentration of sodium fluoride in an equimolar NaCl—KCl molten salt system. FIG. 5 shows that the weight percent of NaF in (NaCl—KCl) did not strongly affect the droplet velocity. As in FIG. 4, the velocity of the molten aluminum was significantly greater than the velocity of the molten UBC alloy. In fact, the aluminum droplet velocity was approximately twice the velocity of the UBC alloy droplet for the same molten salt system and same voltage.

Figure 6:
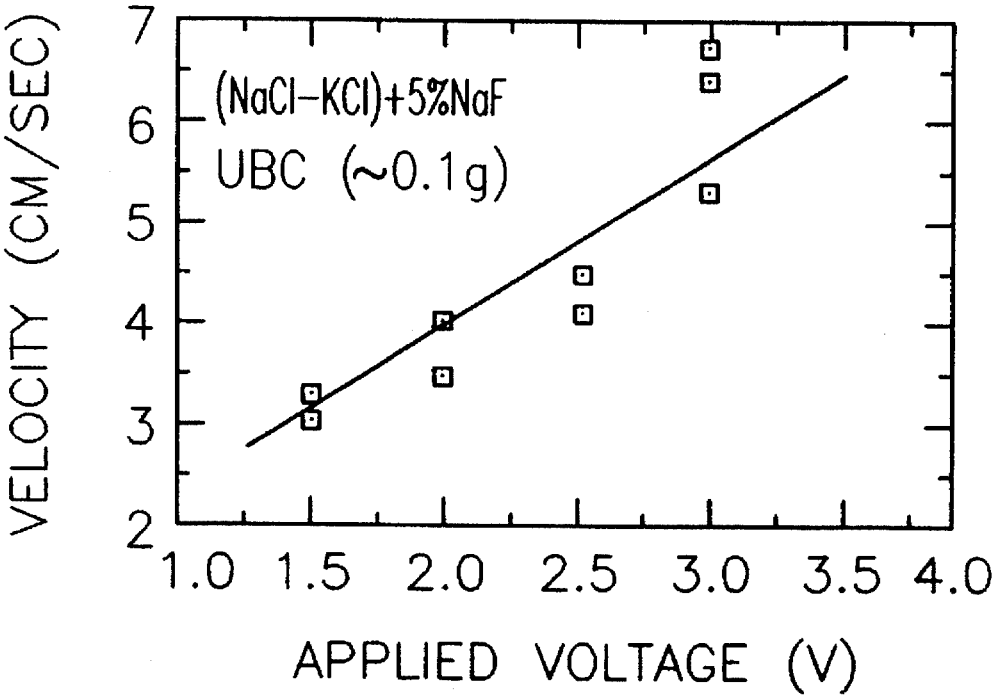
FIG. 6 illustrates a graph of the velocity of UBC alloy droplets as a function of applied voltage.

FIG. 6 illustrates a graph of the velocity of UBC alloy droplets as a function of applied voltage and shows that the UBC alloy droplet velocity increased as the applied potential was increased. The increase was linear up to an applied voltage of about 3.0 volts, at which voltage the metal alloy droplets exhibited an increase in droplet velocity.

Figure 7:
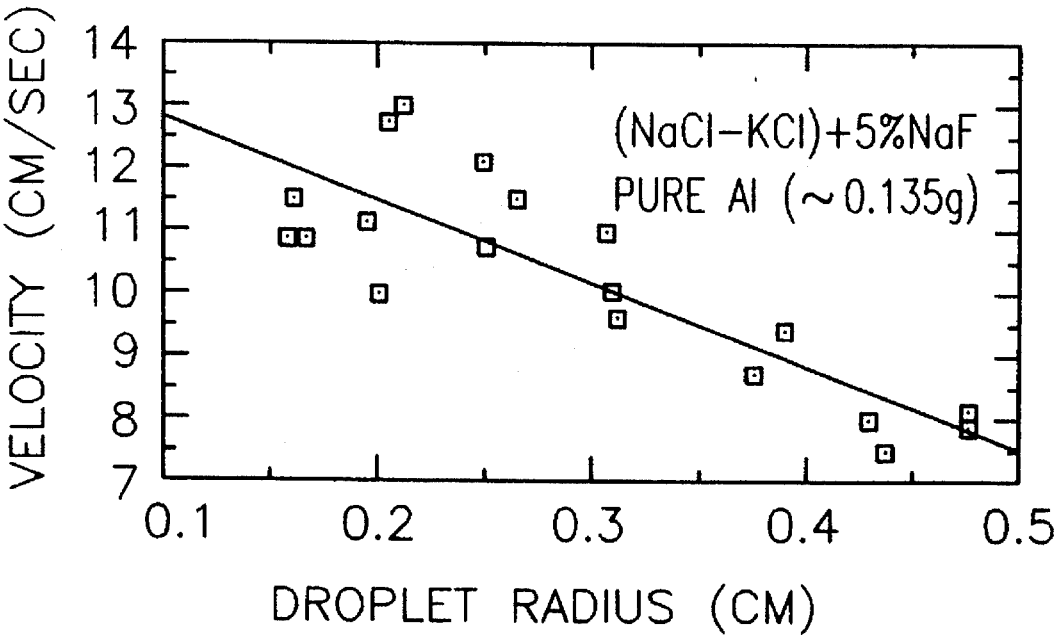
FIG. 7 illustrates a graph of the velocity of pure aluminum droplets as a function of droplet radius.

FIG. 7 illustrates a graph of the velocity of pure aluminum droplets as a function of droplet radius. FIG. 7 illustrates that the droplet velocities decrease as the droplet radii increase. Using the same procedure employed by Millikan with the oil drops, the molten metal droplet radius is calculated based on its density and weight, with an assumption that the droplet is a sphere.

It is preferred herein that the salts be relatively pure or clean and have molten viscosities around 2 centipoise. While molten salts contaminated with oxides and other impurities often are thixotropic and have viscosities which are difficult to measure, such materials are not necessarily excluded from the present invention. In fact, industrial recycling of aluminum uses molten salt systems which are often very contaminated with oxides and other waste materials, whereby the molten salt system is both viscous and darkly colored. Thus, one experiment demonstrating the present invention was performed as follows: about 5 weight percent of aluminum powder (about 20 microns diameter particle size) was mixed with the salt (5 weight percent NaF addition into equimolar NaCl—KCl) in a quartz boat, which was heated for 90 minutes in an oxidizing atmosphere of air. The aluminum powder thus had ample opportunity to oxidize before the temperature reached the melting point of the salt mixture. For two boats with the same salts, one was subjected to an applied potential of 3 volts for 2 minutes, and the other boat was not so subjected. Direct observations were difficult because of the dark coloration, however, the salt with the applied potential had one large metal droplet near the anode. The salt system which did not experience the voltage potential had numerous small droplets uniformly distributed in the quartz boat. This evidences significant loss of metal as a result of the formation of suspensions of both fine and larger metal droplets in the salt solution in the absence of the applied voltage, and a much higher yield of recovered aluminum in the presence of the applied potential. These results indicate that the voltage potential applied to the industrial salt can be used in an optimized geometry to significantly increase the molten metal recovery yield by reducing the amount of fine metal droplets lost in the suspension.

Figure 8A:
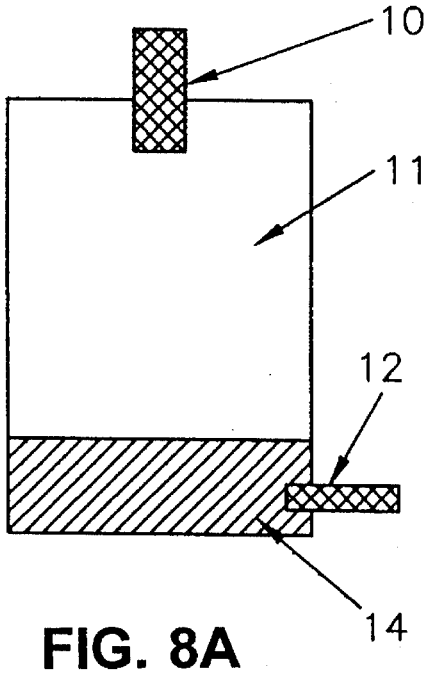
FIG. 8(*a*) and 8(*b*) illustrate two embodiments of the present invention.
Figure 8B:
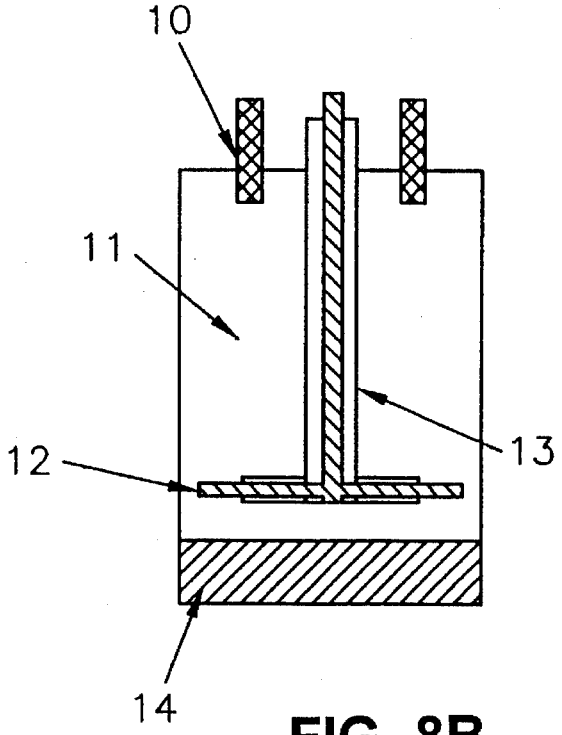

FIG. 8 illustrates two additional embodiments of the present invention. In FIG. 8(*a*), a cathode 10, made of tungsten, molybdenum, graphite, or other material is dipped beneath the surface of the molten salt or salts 11. The recovered metal at the bottom of the furnace acts as an anode 12 to complete the dc circuit. In this manner, the metal droplets in the molten salt move toward the bottom of the furnace as a result of both the applied potential and gravity, where the collected droplets 14 can be recovered in greater yield than in the absence of an applied potential.

In FIG. 8(*b*), the anode 12 has an insulating covering 13 which covers and insulates all of the anode 12 except the end or tip, which is left uncovered to thereby act as the electrically conductive anode. The end or tip of the anode can be a single point or a plurality or a bar-shaped configuration. The insulated anode 12 is inserted into the molten salt 11 to a position and depth such that the uninsulated tip or tips is or are near the bottom of the vessel containing the molten salts and molten metal droplets. In this manner, the metal droplets migrate toward the uninsulated tip or tips of the anode 12 near the bottom of the vessel by means of the applied potential, and the yield of recovered metal 14 is thereby increased.

In another embodiment of the present invention, the insulated anode is rotatable around its longitudinal or vertical axis, thereby sweeping an arc or circle through the salt solution to thereby further increase the yield of recovered metal.

While certain preferred embodiments of the present invention have been disclosed in detail, it is to be understood that various modifications may be adopted without departing from the spirit of the invention or scope of the following claims.

We claim:

1. A method for increasing the yield of recovered metal from a solution of molten metal droplets and molten salt without dissociation or reduction of alumina, said method comprising the steps:

(a) immersing a first and second electrodes into a solution comprising molten salt, at least one fluoride salt additive, and droplets of molten metal comprising aluminum;

(b) applying an electrical potential between the electrodes, whereby the first electrode becomes the anode and the second electrode becomes the cathode, whereby the electrical potential induces the molten metal droplets to migrate toward the anode, and whereby the electrical potential is insufficient to dissociate or reduce alumina; and (c) collecting the molten metal at the anode.

2. The method of claim 1 wherein the molten salt comprises sodium chloride and potassium chloride with a fluoride addition.

3. The method of claim 1 wherein the molten salt comprises sodium chloride and potassium chloride in a molar proportion ranging from 30 to 60 mole percent with a fluoride addition.

4. The method of claim 1 wherein the molten salt comprises sodium chloride and potassium chloride in an equimolar mixture with a fluoride addition.

5. The method of claim 1 wherein the fluoride salt additive is selected from the group consisting of sodium fluoride, potassium fluoride, lithium fluoride, sodium aluminum fluoride, and mixtures and precursors thereof.

6. The method of claim 5 wherein the additive is present in an amount of from about 0.1 weight percent to about 15 weight percent.

7. The method of claim 1 wherein the molten metal comprises an aluminum alloy.

8. The method of claim 1 wherein the molten metal comprises recycled metal from used beverage cans.

9. The method of claim 1 wherein the metal is selected from the group consisting of aluminum, aluminum alloy, used beverage cans, and mixtures thereof.

10. The method of claim 1 wherein the electrodes are selected from the group consisting of tungsten, carbon, graphite, and molybdenum.

11. The method of claim 1 wherein the migration of the metal droplets increases the coalescence of the droplets, whereby the droplets increase in size.

12. The method of claim 1 wherein the anode is electrically insulated except for a region at the end of the anode.

13. The method of claim 12 wherein the insulated anode can rotate within the solution.

14. The method of claim 12 wherein the solution is held in a receptacle made of a material selected from the group consisting of quartz, silicon nitride, silicon carbide, boron nitride, magnesium oxide, and alumina.

15. The method of claim 1 wherein the anode has a plurality of electrically conductive ends.

16. The method of claim 1 wherein the applied electrical potential is 1 volt to 5.0 volts.

17. The method of claim 1 wherein the solution of molten metal droplets and molten salt is the dross removed from an aluminum recycling molten salt system.

18. The method of claim 1 wherein the molten metal and molten salt are melted within a static (or batch) furnace.

19. The method of claim 1 wherein the molten metal and molten salt are melted within a dynamic (or continuous flow type) furnace. reconsideration of the claims in view of the following amendments and remarks which reflect the telephone discussions and the Examiner's suggestions.

20. A method of reducing the amount of waste dross generated per unit volume of recycled aluminum or aluminum alloys without dissociation or reduction of alumina, said method comprising:

(a) immersing a first and second electrodes into a solution comprising molten salt, at least one fluoride salt additive, and molten droplets of aluminum or aluminum alloys, wherein the solution has a layer of dross on its surface;

(b) applying an electrical potential between the electrodes, whereby the first electrode becomes the anode and the second electrode becomes the cathode, whereby the electrical potential induces the molten droplets to migrate toward the anode, and whereby the electrical potential is insufficient to dissociate or reduce alumina; and (c) collecting the molten aluminum or aluminum alloys at the anode, whereby the application of the electrical potential increases the yield of recovered molten aluminum or aluminum alloy, and whereby the amount of waste dross generated per unit volume of recovered aluminum or aluminum alloy is reduced relative to the amount of waste dross generated in the absence of the applied electrical potential.

21. A method for extending the useful life of a salt flux used in the recycling of aluminum or aluminum alloy without dissociation or reduction of alumina, said method comprising:

(a) immersing a first and second electrodes into a salt flux solution comprising molten salt, at least one fluoride salt additive, and molten droplets of aluminum or aluminum alloy;

(b) applying an electrical potential between the electrodes, whereby the first electrode becomes the anode and the second electrode becomes the cathode, whereby the electrical potential induces the molten droplets to migrate toward the anode, and whereby the electrical potential is insufficient to dissociate or reduce alumina; and (c) collecting the molten aluminum or aluminum alloy at the anode, whereby the application of the electrical potential increases the yield of recovered molten aluminum, and whereby the useful life of the salt flux solution is extended relative to the life of the salt flux in the absence of the applied electrical potential.

* * * * *

UNITED STATES PATENT AND TRADEMARK OFFICE

CERTIFICATE OF CORRECTION

PATENT NO. : 5,516,353

DATED : May 14, 1996

INVENTOR(S) : Sahai et al.

It is certified that error appears in the above-indentified patent and that said Letters Patent is hereby corrected as shown below:

Column 2, line 62, delete "rs." and insert --vs.--. Column 4, line 16, delete "$\psi$" and insert --$\gamma$--. Column 6, line 65, after "FIG. 9" and before "lists" insert --. FIG. 9--.

Col. 9, Claim 19, line 3, after "furnace." delete "reconsideration of the claims in view of the following amendments and remarks which reflect the telephone discussions and the Examiner's suggestions."

Signed and Sealed this

Thirtieth Day of July, 1996

*Attest:*

Bruce Lehman

BRUCE LEHMAN

*Attesting Officer*

*Commissioner of Patents and Trademarks*